US007637574B2

(12) United States Patent
Hall et al.

(10) Patent No.: US 7,637,574 B2
(45) **Date of Patent: *Dec. 29, 2009**

(54) PICK ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Scott Dahlgren, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 105 days.

This patent is subject to a terminal disclaimer.

(21) Appl. No.: 11/844,662

(22) Filed: Aug. 24, 2007

(65) Prior Publication Data

US 2008/0036280 A1 Feb. 14, 2008

Related U.S. Application Data

(63) Continuation of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/844,662, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/111; 299/104

(58) Field of Classification Search ..... 299/111, 299/104, 113
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Tyson J. Wilde

(57) ABSTRACT

A high impact resistant pick in a holder having a super hard material bonded to a cemented metal carbide substrate at a non-planar interface. The cemented metal carbide substrate is bonded to a front end of a cemented metal carbide bolster. A bore is formed in a base end of the carbide bolster generally opposed to the front end. A steel shank being fitted into the bore of the bolster at a bolster end of the shank, and a portion of the shank is disposed within a bore of the holder at a holder end of the shank.

15 Claims, 17 Drawing Sheets

U.S. PATENT DOCUMENTS 2,124,438 A 7/1938 Struk
3,254,392 A 6/1966 Novkov
3,397,012 A * 8/1968 Krekeler ..... 299/104
3,746,396 A 7/1973 Radd
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,247,150 A * 1/1981 Wrulich et al. ..... 299/104
4,277,106 A 7/1981 Sahley
4,439,250 A 3/1984 Acharya
4,465,221 A 8/1984 Schmidt
4,484,644 A 11/1984 Cook
4,489,986 A 12/1984 Dziak
4,627,665 A * 12/1986 Ewing et al. ..... 299/113
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,746,379 A * 5/1988 Rabinkin ..... 148/403
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,415,462 A * 5/1995 Massa ..... 299/106
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,966,611 B1 11/2005 Sollami
6,994,404 B1 2/2006 Sollami
7,204,560 B2 4/2007 Mercier
2002/9175555 11/2002 Mercier
2003/0137185 A1 * 7/2003 Sollami ..... 299/106
2003/0140350 A1 7/2003 Noro
2003/0209366 A1 11/2003 McAlvain
2003/0230926 A1 * 12/2003 Mondy et al. ..... 299/105
2003/0234280 A1 12/2003 Cadden
2004/0026132 A1 * 2/2004 Hall et al. ..... 175/427
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

PICK ASSEMBLY

CROSS REFERENCE TO RELATED APPLICATIONS

This application is a continuation of U.S. patent application Ser. No. 11/844,586, filed on Aug. 24, 2007, now U.S. Pat. No. 7,600,823 which is a continuation-in-part of U.S. patent application Ser. No. 11/829,761, which was filed on Jul. 27, 2007. U.S. patent application Ser. No. 11/829,761 is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation-in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006 now U.S. Pat. No. 7,445,294. U.S. patent application Ser. No. 11/463,975 is a continuation-in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation-in-part of U.S. patent application Ser. No. 11/695,672 which was filed on Apr. 3, 2007 now U.S. Pat. No. 7,396,086. U.S. patent application Ser. No. 11/695,672 is a continuation-in-part of U.S. patent application Ser. No. 11/686,831 filed on Mar. 15, 2007 now U.S. Pat. No. 7,568,770. All of these applications are herein incorporated by reference for all that they contain.

BACKGROUND OF THE INVENTION

Formation degradation, such as pavement milling, mining, or excavating, may result in wear on impact resistant picks. Consequently, many efforts have been made to extend the working life of these picks by optimizing the shape of the picks or the materials with which they are made. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, all of which are herein incorporated by reference for all that they contain.

BRIEF SUMMARY OF THE INVENTION

A high-impact resistant pick in a holder having a super hard material bonded to a cemented metal carbide substrate at a non-planar interface. The cemented metal carbide substrate is bonded to a front end of a cemented metal carbide bolster. A bore is formed in a base end of the carbide bolster generally opposed to the font end. A steel shank being fitted into the bore of the bolster at a bolster end of the shank, and a portion of the shank is disposed within a bore of the holder at a holder end of the shank.

The bore and bolster end of the shank may be tapered. The bolster end of the shank may be compliant. The shank may comprise an inset portion at the holder end and is substantially straight from the inset portion to the bolster end of the shank. The shank may comprise a smooth outer diameter from the inset portion and the bolster end. The shank may comprise an equal diameter from the inset portion to the bolster end. A portion of the shank from the holder end to the bolster end may be in direct contact with the bore of the holder.

The bore of the holder may be case-hardened. The shank may be work-hardened. An outside diameter of the holder may comprise hard-facing. The base of the bolster extends radially past the outer diameter of the holder and the hard-facing. The bore of the holder may comprise lubrication. A weeping seal may be disposed around the shank such that it is in contact with the shank, the holder, and the bolster.

A cross-sectional distance between the bore of the bolster to an outer edge of the bolster is at least 0.200 inch. The bolster may be in direct contact with an upper face of the holder. The shank and bolster may comprise an interference fit from 0.0005 to 0.005 inch. The bolster end of the shank which is fitted into the bolster may comprise a length from 0.300 to 0.700 inch. The bore of the bolster may comprise a depth from 0.600 to 1 inch. A ratio of a width of a base of the bolster to a width of the shank may be from 1.5:1 to 2.5:1. A ratio of a length of the shank to a length of the bolster may be from 1.75:1 to 2.5:1. A gap of at least 0.001 inch may exist between the shank and the bore of the holder.

The carbide substrate and carbide bolster may be brazed with a braze material comprising 30 to 62 weight percent of palladium. The carbide substrate may comprise a center thickness from 0.900 to 0.150 inch. The super hard material may comprise a substantially pointed geometry with an apex comprising a 0.050 to 0.165 inch radius, and a 0.100 to 0.500 inch thickness from the apex to the non-planar surface. The super hard material may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal bonded diamond, and combinations thereof.

DETAILED DESCRIPTION OF THE INVENTION AND THE PREFERRED EMBODIMENT

Figure 1:
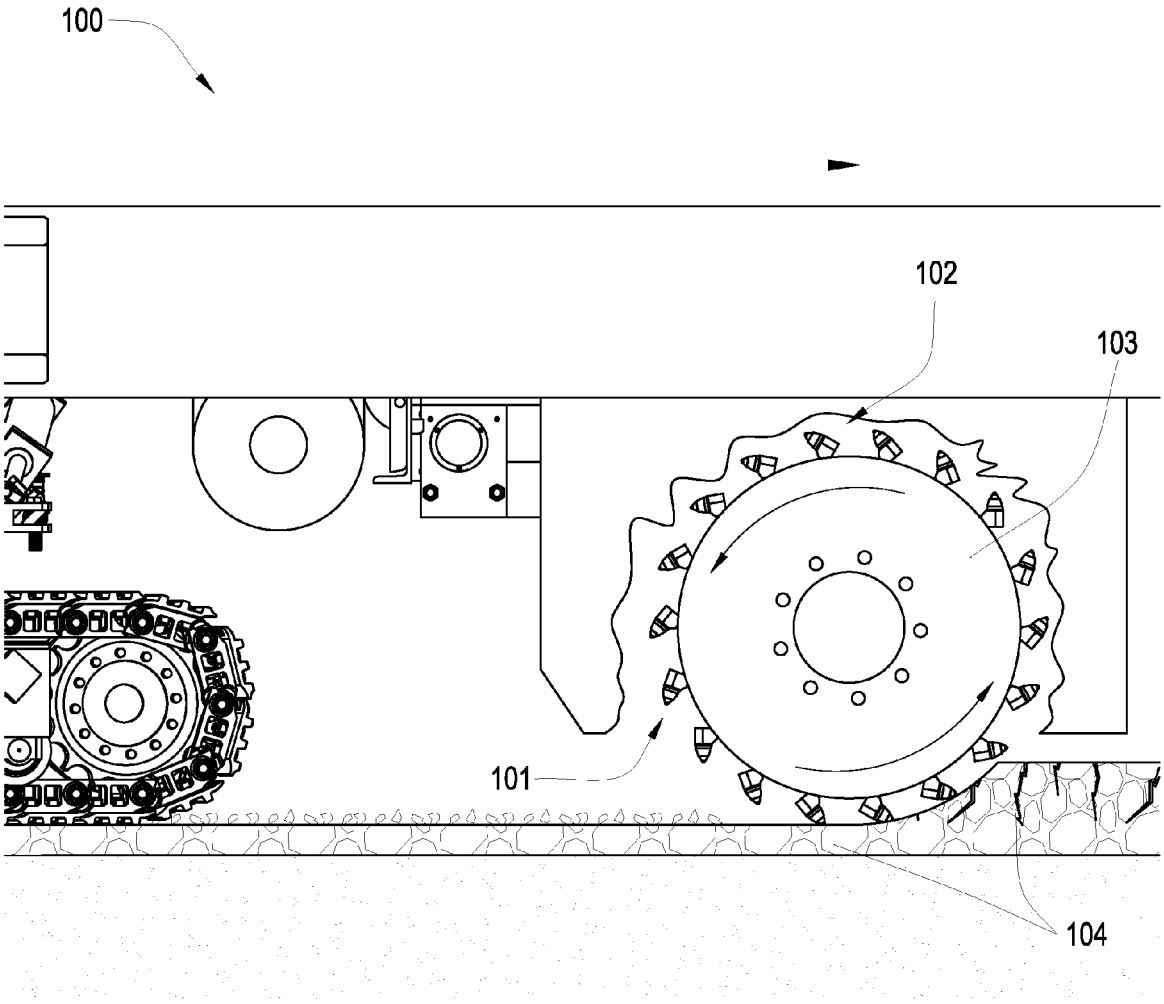
FIG. 1 is a cross-sectional diagram of an embodiment of a recycling machine.

FIG. 1 is a cross-sectional diagram of an embodiment of a plurality of picks 101 attached to a driving mechanism 103, such as rotating drum, connected to the underside of a pavement recycling machine 100. The recycling machine 100 may be a cold planer used to degrade man-made formations such as a paved surface 104 prior to the placement of a new layer of pavement. Picks 101 may be attached to the driving mechanism bringing the picks 101 into engagement with the formation. A holder 102, which may be a block or an extension in the block, is attached to the driving mechanism 103, and the pick 101 is inserted into the holder 102. The holder 102 or block may hold the pick 101 at an angle offset from the direction of rotation, such that the pick 101 engages the pavement at a preferential angle.

Figure 2:
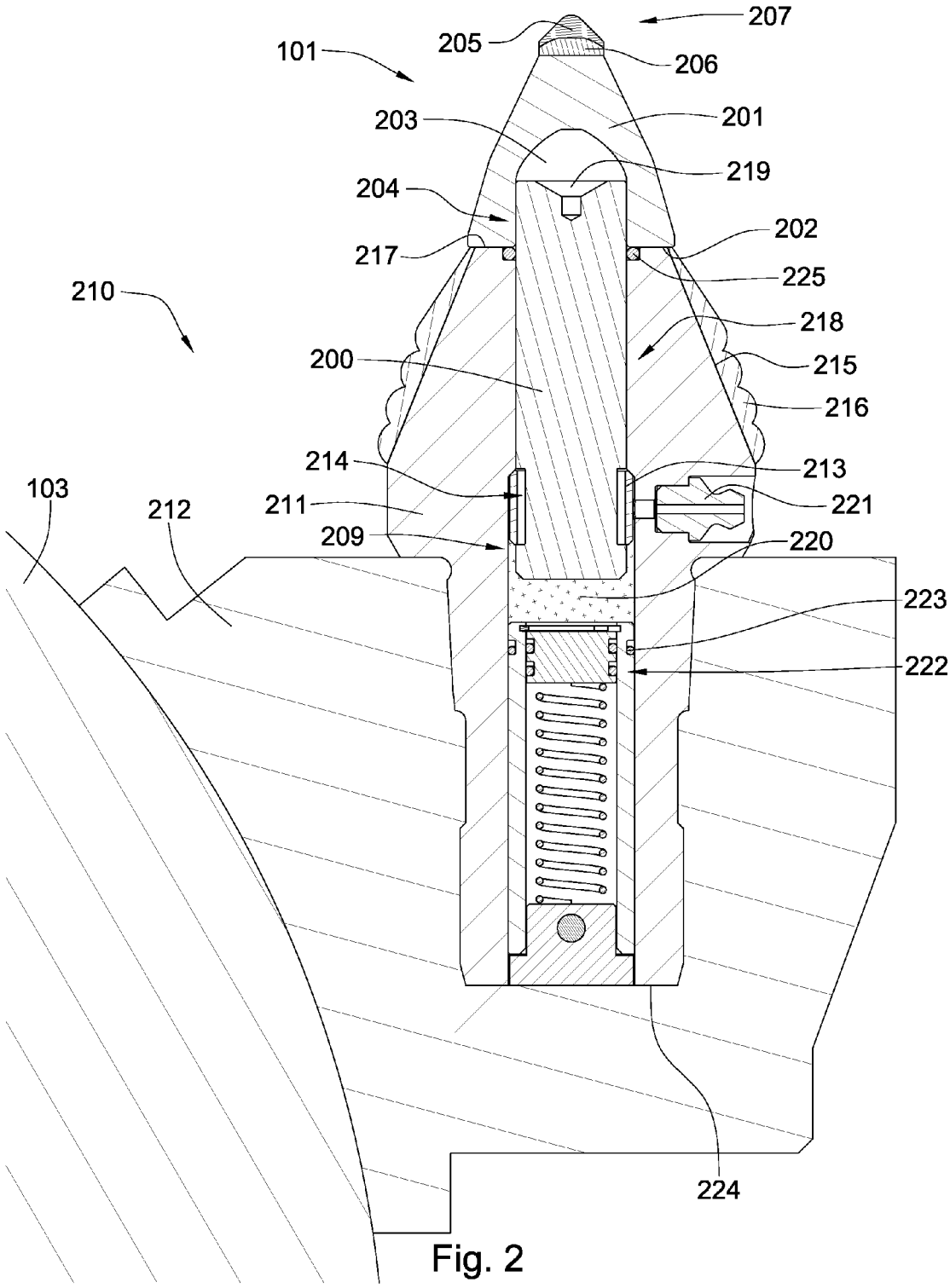
FIG. 2 is a cross-sectional diagram of an embodiment of a high-impact resistant pick.

Referring now to the embodiment of FIG. 2, each pick 101 may be designed for high-impact resistance and long life while milling the paved surface 104. The pick 101 comprises a shank 200 press fitted into a bore 203 of a base 202 of a cemented metal carbide bolster 201 at a bolster end 204 of the shank 200. A super hard material 205 is bonded to a cemented metal carbide substrate 206 to form a wear-resistant tip 207, which is then bonded to the bolster 201 at a front end 208 of the bolster 201 generally opposed to the base end 202. The shank 200 may comprise a hard material such as steel, hardened steel, or other materials of similar hardness. The bolster 201 may comprise tungsten, titanium, tantalum, molybdenum, niobium, cobalt and/or combinations thereof. The super hard material 205 may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal-bonded diamond, silicon carbide, cubic boron nitride, and combinations thereof.

A holder end 209 of the shank 200 is disposed within a bore 218 of a holder 210, which may comprise an extension 211, a block 212 attached to the driving mechanism 103, or both. The shank 200 may be held into the holder 210 by a retaining clip 213 adapted to fit in an inset portion 214 of the holder end 209. An outer diameter 215 of the holder 210 may comprise a hard-facing 216 in order to provide better wear protection for the holder 210. The hard-facing 216 may comprise ridges after it is applied, though the ridges may be machined down afterward. The base 202 of the bolster 201 may be in direct contact with an upper face 217 of the holder 210, and may overhang the holder 210 and hard-facing 216, which may prevent debris from collecting on the upper face 217. The bore 218 of the holder 210 may comprise a hard-facing. One method of hard-facing the bore is case-hardening, during which process the bore is enriched with carbon and/or nitrogen and then heat treated, which hardens the bore and provides wear protection although other methods of hard-facing the bore may also be used.

The shank 200 may be work-hardened in order to provide resistance to cracking or stress fractures due to forces exerted on the pick by the paved surface 104 or the holder 210. The shank 200 may be work-hardened by shot-peening the shank, chrome plating the shank, enriching the shank with nitrogen, or other methods of work-hardening. The shank may also be rotatably held into the holder, such that the pick 101 is allowed to rotate within the holder 210 such that the pick and holder may wear generally evenly. The bolster end 204 of the shank 200 may also comprise a recess 219 or grooves to provide compliance to the bolster end 204.

The pick 101 may be lubricated. A lubricant 220 may be inserted into the bore 218 of the holder 210 by way of a one-way valve 221. A piston assembly 222 may be disposed within the bore 218 such that as more lubricant 220 is inserted into the bore 218, the piston assembly 222 may compress to allow the lubricant 220 to be inserted. After the lubricant 220 is inserted into the bore 218, the piston assembly 222 may apply pressure on the lubricant 220, which may force it up around the shank 200 and out of the holder 210. The piston assembly 222 may comprise seals 223 which may prevent the lubricant 220 from exiting a base 224 of the extension 211. This may allow the pick to rotate more easily and may decrease friction while the pick rotates for better wear protection of areas in contact with the holder 210, such as the base 202 of the bolster 201 and the shank 200. A weeping seal 225 may be disposed around the shank 200 such that it is in contact with the shank 200, the bolster 201, and the holder 210, which may limit the rate at which the lubricant 220 is expelled from the bore 218.

The lubrication may also be provided from the driving mechanism. In embodiments, where the driving mechanism is a drum, the drum may comprise a lubrication reservoir and a port may be form in the drum which leads to the lubrication reservoir. The lubrication reservoir may be pressurized to force the lubrication between the shank and the bore of the holder. The weeping seal may provide the benefit of preventing debris from entering between the shank and the holder bore, while allowing some lubricant to escape to keep the seal clean. In some embodiments a spiral groove may be formed in the shank or the bore of the holder to aid in exposing the surfaces or the shank and the holder bore to the lubricant. In some embodiments, the lubricant is added to the bore of the holder prior to securing the shank within the holder. In such an embodiment, the insertion of the shank will penetrate the volume of the lubricant forcing a portion of the volume to flow around the shank and also compressing the lubricant within the bore.

Figure 3:
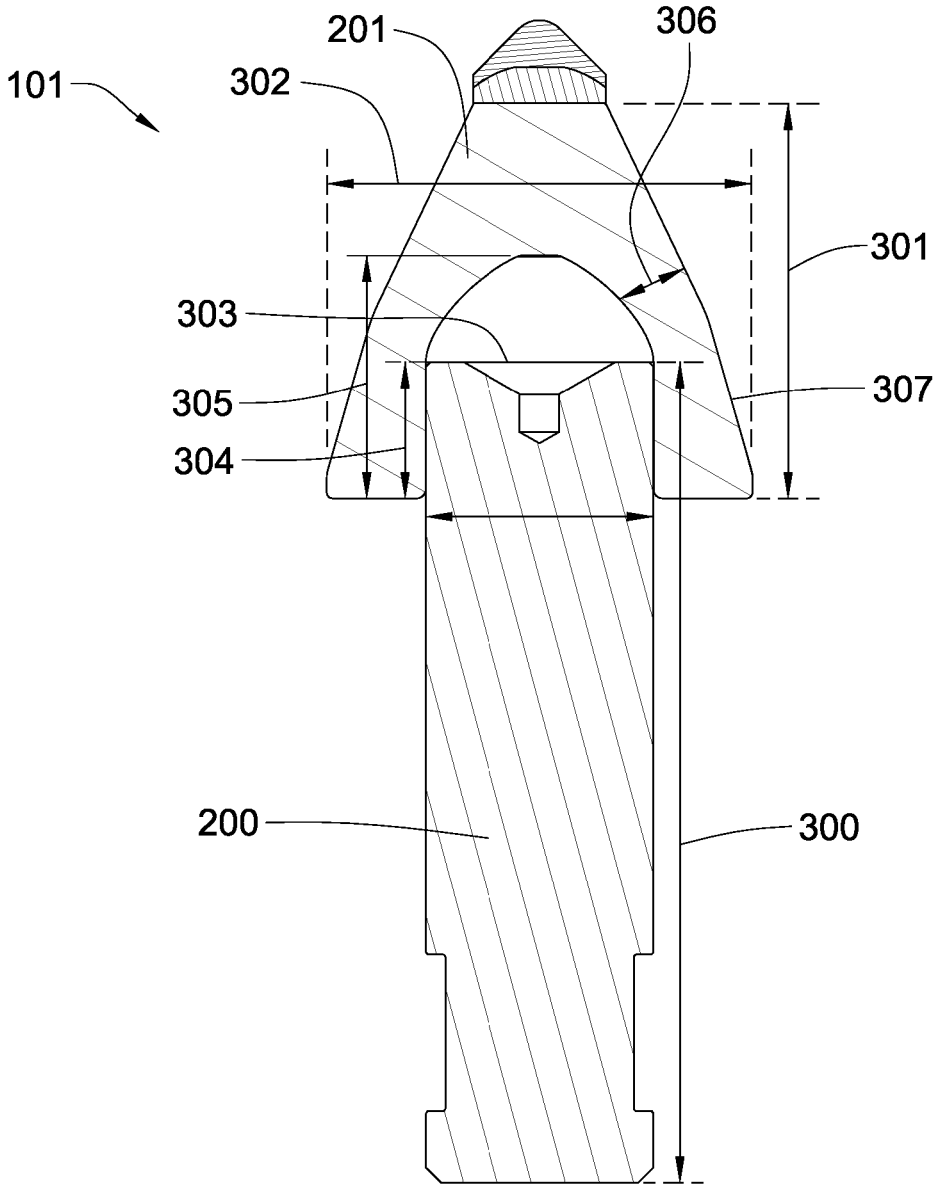
FIG. 3 is a cross-sectional diagram of another embodiment of a high-impact resistant pick.

Referring to the embodiment of FIG. 3, dimensions of the shaft 200 and bolster 201 may be important to the function and efficiency of the pick 101. A ratio of a length 300 of the shank 200 to a length 301 of the bolster 201 may be from 1.75:1 to 2.5:1. A ratio of a width 302 of the bolster 201 to a width 303 of the shank 200 may be from 1.5:1 to 2.5:1. A length 304 of the bolster end 204 of the shank 200 which is fitted into the bore 203 of the bolster 201 may be from 0.300 to 0.700 inches. The bore 203 of the bolster 201 may comprise a depth 305 from 0.600 to 1 inch. The shank 200 may or may not extend into the full depth 305 of the bore 203. The shank 200 and bolster 201 may also comprise an interference fit from 0.0005 to 0.005 inches. The bolster may comprise a minimum cross-sectional thickness 306 between the bore 203 and an outer diameter 307 of the bolster of 0.200 inch, preferable at least 0.210 inches. Reducing the volume of the bolster 201 may be advantageous by reducing the cost of the pick 101.

Figure 4:
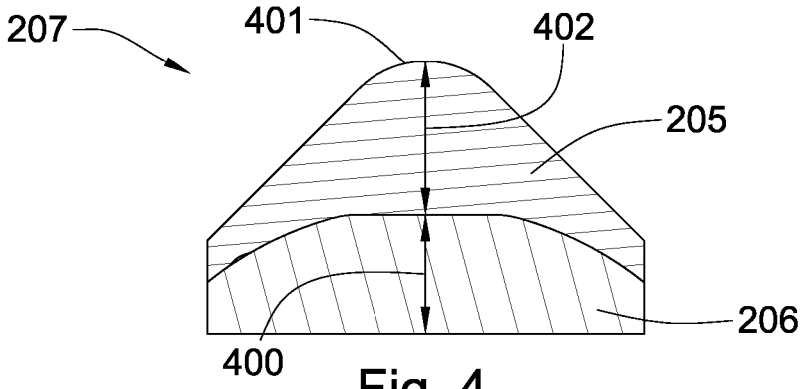
FIG. 4 is a cross-sectional diagram of an embodiment of a super hard material bonded to a cemented metal carbide substrate.

Referring now to FIG. 4, the cemented metal carbide substrate 206 may comprise a center thickness 400 from 0.090 to 0.250 inches. The super hard material 205 bonded to the substrate may comprise a substantially pointed geometry with an apex 401 comprising a 0.050 to 0.160 inch radius, and a 0.100 to 0.500 inch thickness 402 from the apex 401 to an interface 403 where the super hard material 205 is bonded to the substrate 206. Preferably, the interface 403 is non-planar, which may help distribute loads on the tip 207 across a larger area of the interface 403. The side wall of the superhard material may form an included angle with a central axis of the tip between 30 to 60 degrees. In asphalt milling applications, the inventors have discovered that an optimal included angle is 45 degrees, where in mining applications the inventors have discovered that an optimal included angle is between 35 and 40 degrees. A tip that may be compatible with the present invention is disclosed in U.S. patent application Ser. No. 11/673,634 to Hall and is currently pending.

Figure 5:
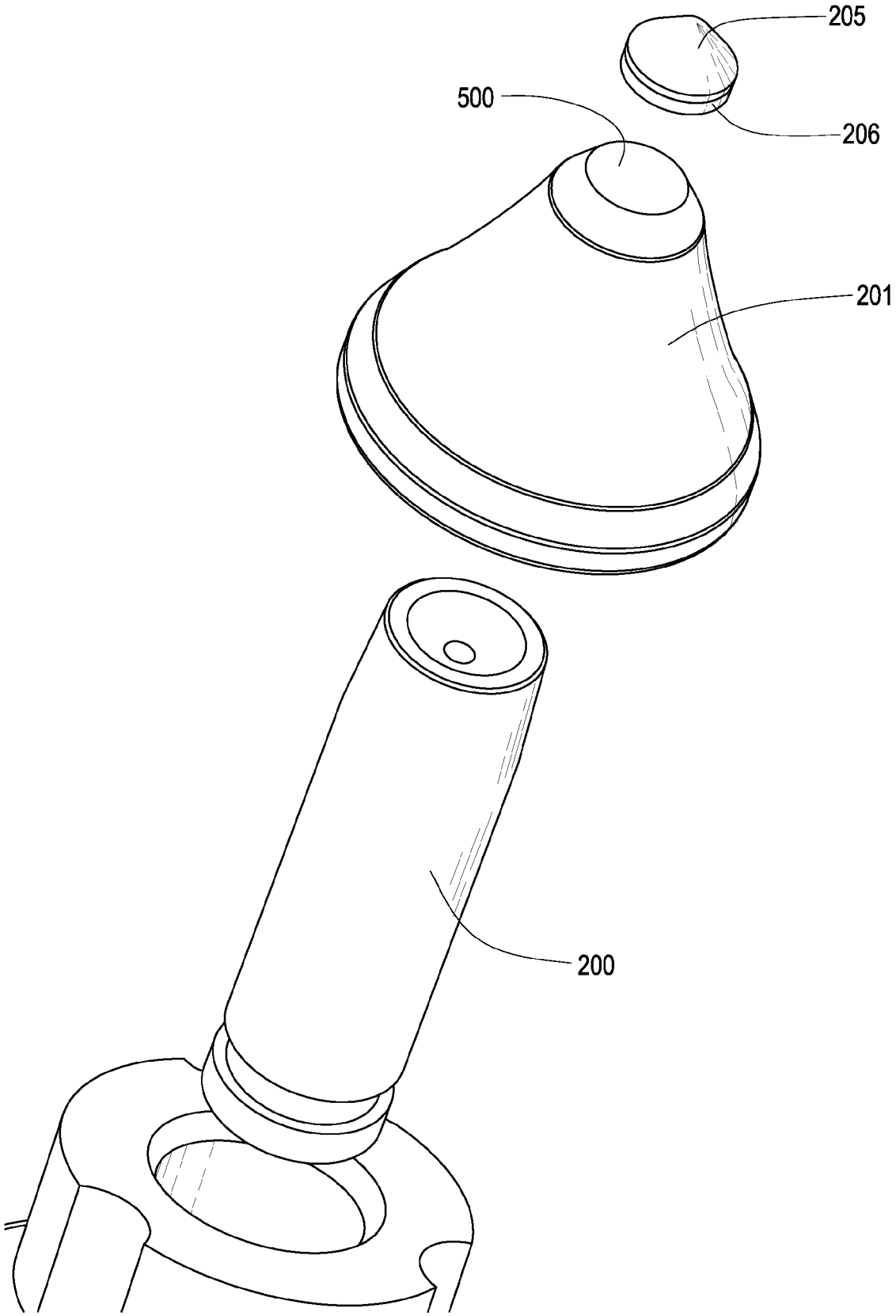
FIG. 5 is an exploded diagram of another embodiment of a high-impact resistant pick.

The wear-resistant tip 207 may be brazed onto the carbide bolster 201 at a braze interface 500, as in the embodiment of FIG. 5. Braze material used to braze the tip to the bolster 201 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 206 and the super hard material 205. The farther away the super hard material is from the braze interface 500, the less thermal damage is likely to occur during brazing. Increasing the distance between the brazing interface 500 and the super hard material 205, however, may increase the moment on the carbide substrate and increase stresses at the brazing interface upon impact. The shank 200 may be press fitted into the bolster before or after the tip is brazed onto the bolster 201.

Figure 6:
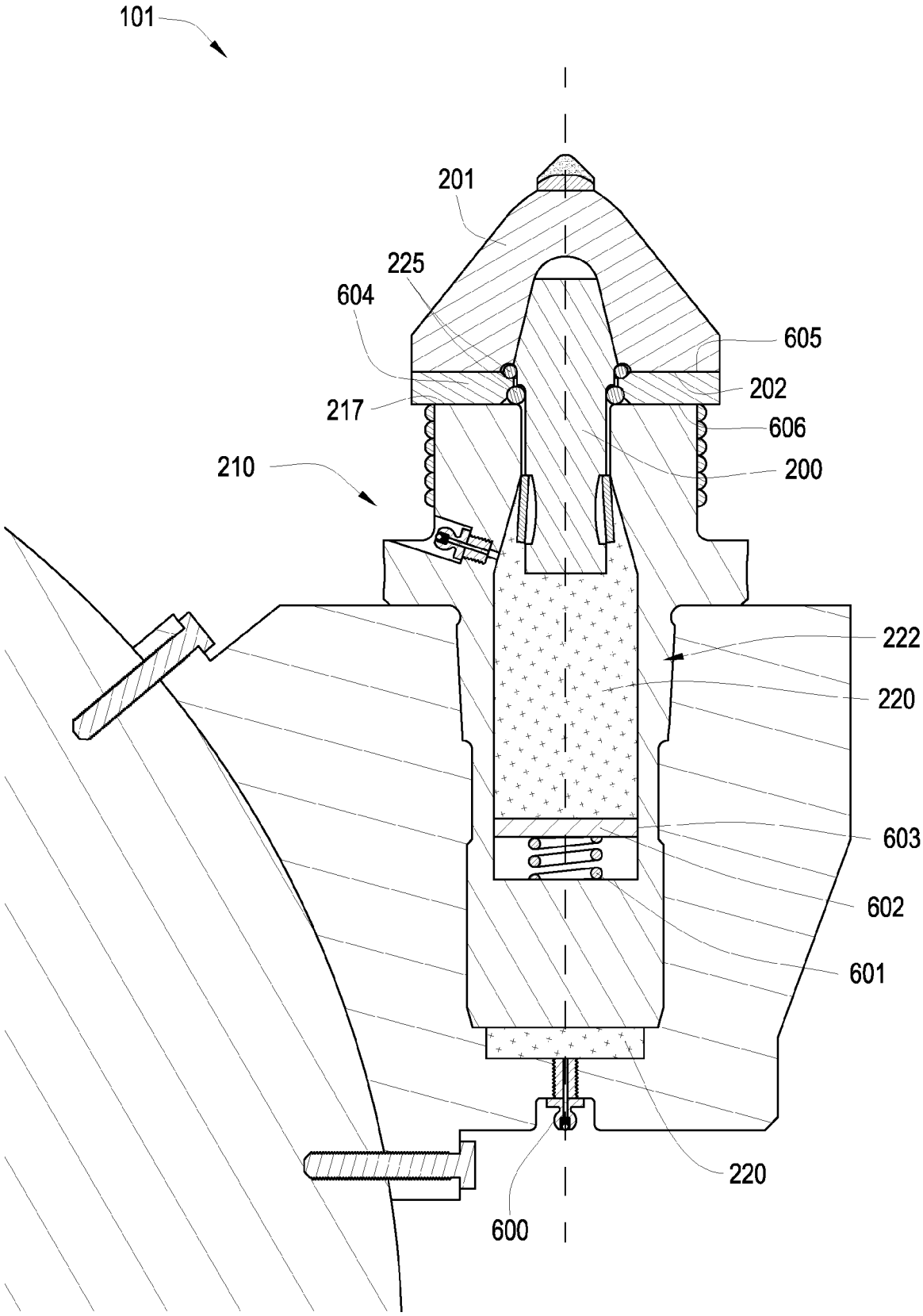
FIG. 6 is a cross-sectional diagram of an embodiment of a high-impact resistant pick disposed within a holder.

The pick 101 may comprise a thick, wide bolster 201, as in the embodiment of FIG. 6. The holder 210 may also comprise a second one-way valve 600 which may be used to insert additional lubricant 220 into the bore 218 of the holder 210 or into another area of the holder 210. The piston assembly 222 may comprise a spring 601 attached to a plate 602. An outer diameter 603 of the plate 602 may comprise a bearing surface adapted to slide within the bore 218 of the holder 210. In the current embodiment, the piston assembly 222 is compressed due to the lubricant 220 in the bore 218. The pick 101 may also comprise a washer 604 disposed around the shank 200 and adapted to contact both the base 202 of the bolster 201 and the upper face 217 of the holder 210. A plurality of weeping seals 225 may be disposed around the shank 200 to allow for lubricant 220 to lubricate both an upper 605 and lower surface 606 of the washer 604. The washer may comprise a material adapted to absorb forces as the pick impacts the paved surface 104. Either the bore 218 of the holder 210 or the shank 200 may comprise grooves which may provide lubrication path for the lubricant 220. In some embodiments there may be a low friction surface between the base end of the bolster and the holder. In some embodiments, the base end of the bolster and/or the holder may be polished. The depth of the bore in the bolster base end may less than one-third the overall length of the shank. The length of the bolster end of the shank that is press fit into the carbide bolster is 0.250 to 1 inch.

Figure 7:
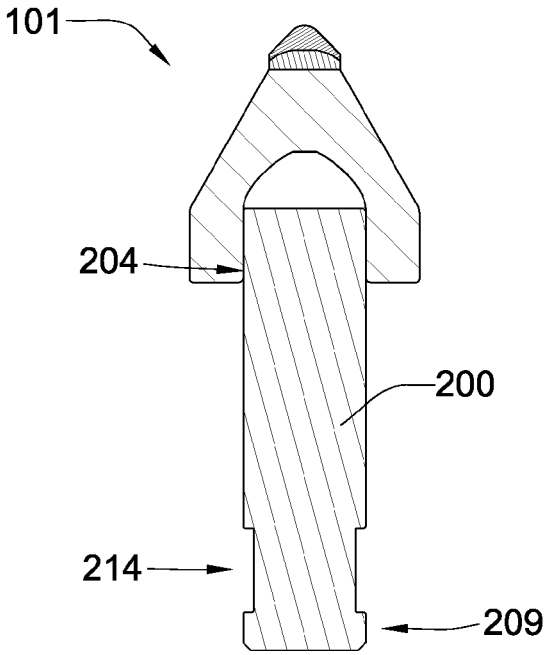
FIG. 7 is a cross-sectional diagram of another embodiment of a high-impact resistant pick.
Figure 8:
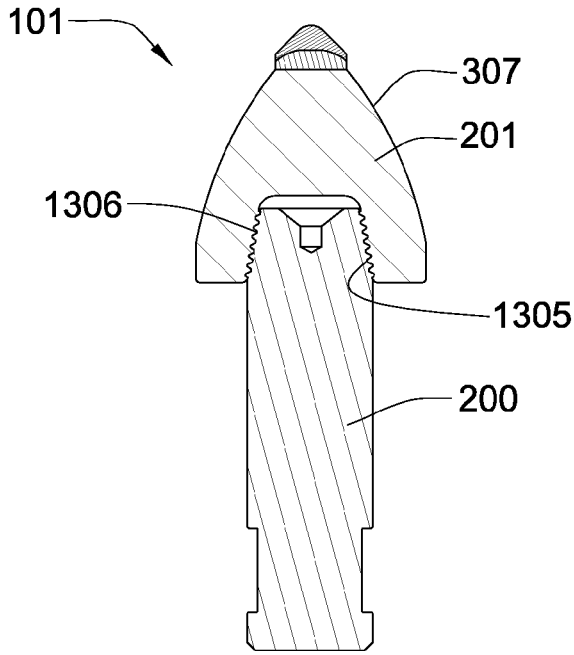
FIG. 8 is a cross-sectional diagram of another embodiment of a high-impact resistant pick.
Figure 9:
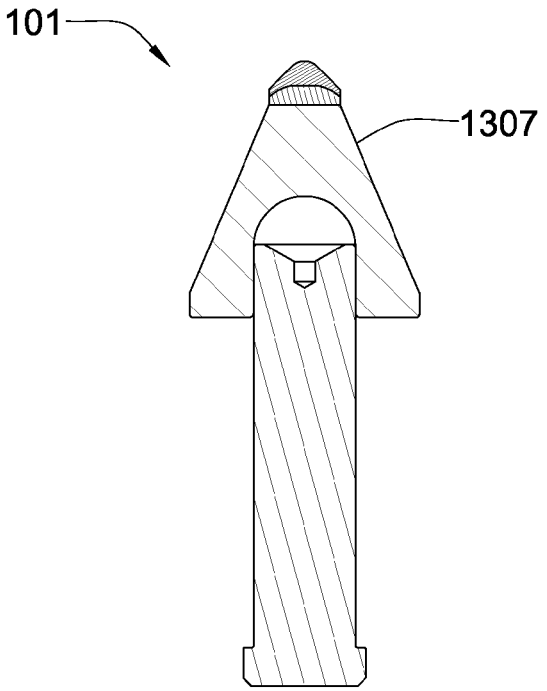
FIG. 9 is a cross-sectional diagram of another embodiment of a high-impact resistant pick.
Figure 10:
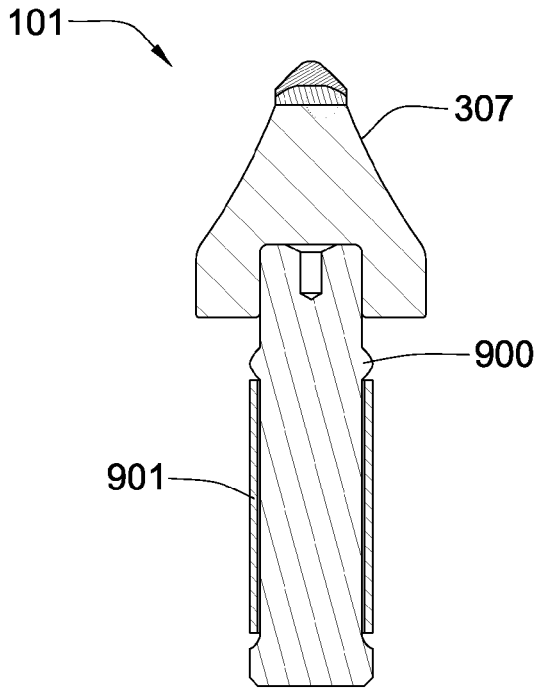
FIG. 10 is a cross-sectional diagram of another embodiment of a high-impact resistant pick.

Referring to the embodiment of FIG. 7, the pick 101 may comprise a shank 200 with an equal diameter 700 between the inset portion 214 of the holder end 209 and the bolster end 204. The bolster end 204 may be flat without grooves or recesses. The bolster end 204 of the shank 200 may be threaded engaged to the bore of the bolster, as in the embodiment of FIG. 8. The threads 1305 in the shank and/or in the threads 1306 in the bolster may be course threads. The treads may be tapered or straight. The threads may comprise at least The bolster 201 may also comprise a straight taper 1307 as in the embodiment of FIG. 9. The shank 200 may comprise ridges 900 or nodules such that a retaining sleeve 901 may be fitted around the shank 200, as in the embodiment of FIG. 10. The sleeve 901 may provide wear protection for the shank while in the bore of the holder and it may help retain the shank in the holder. The ridges 900 may be rounded, as in the embodiment of FIG. 10, which may reduce stress risers in the shank 200 and may prevent cracks from forming in the shank. The bolster 201 may also comprise a concave outer diameter 307.

The bolster end 204 comprise Morse taper of size 0 to size 7, a Brown taper size 1 to size 18, a Sharpe taper size 1 to 18, a R8 taper, a Jacobs taper size 0 to size 33, a Jarno taper size 2 to 20, a NMTB taper size 25 to 60, or modifications or combinations thereof. In some embodiments, the receiving end may comprise no taper. The bolster end may be connected to the base end 202 by a mechanical fit such as a press fit or the bolster end 204 may be connected to the base end 202 by a bond such as a braze or weld.

Figure 11:
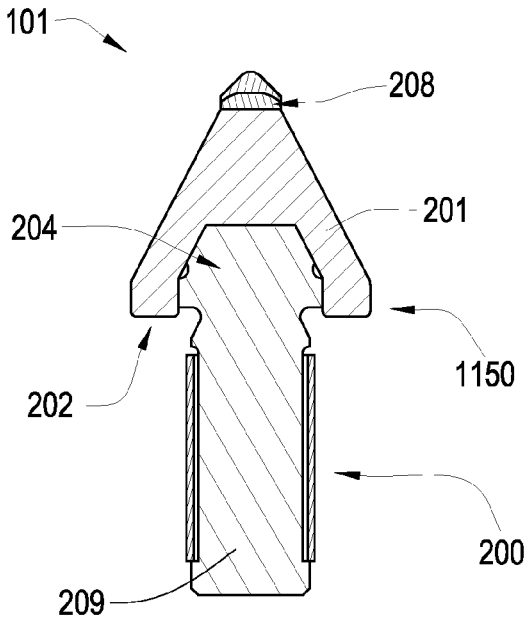
FIG. 11 is a cross-sectional diagram of another embodiment of a high-impact resistant pick.
Figure 12:
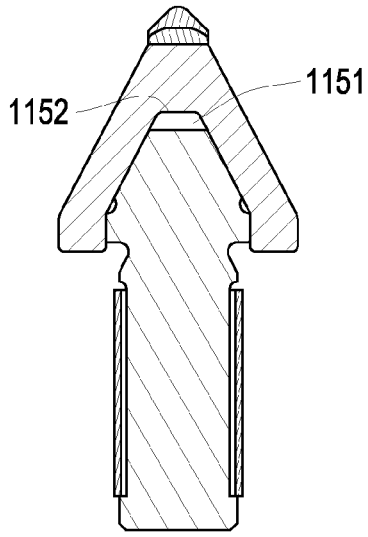
FIG. 12 is a cross-sectional diagram of another embodiment of a high-impact resistant pick.

FIG. 11 is a cross-sectional diagram of an embodiment of a pick 101. The carbide bolster 201 may comprise an overhang 1150 opposite the front end 208. The overhang 1150 may be in contact with the holder 102. The bolster end may be larger in diameter than the holder end 209 of the shank 200. The bolster end may comprise a complimentary geometry to the bore within the carbide bolster. The shank 200 may comprise at least one reentrant on the bolster end. Referring to FIG. 12 there may be a space 1151 between a ceiling 1152 of the carbide bolster and the bolster end disposed within the carbide bolster.

Figure 13:
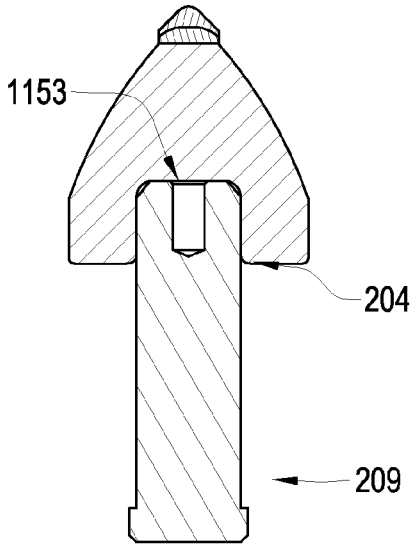
FIG. 13 is a cross-sectional diagram of another embodiment of a high-impact resistant pick.

FIG. 13 is a cross-sectional diagram of another embodiment of a pick. The bolster end may comprise interior slits 1153. The slits 1153 may comprise a taper within the shank. The base end of the carbide bolster may be rectangular, conical, square, elliptical, or a combination thereof and may contact the holder. The diameter of the bolster end 204 may be substantially equal to the diameter of the holder end 209 of the shank 200.

Figure 14:
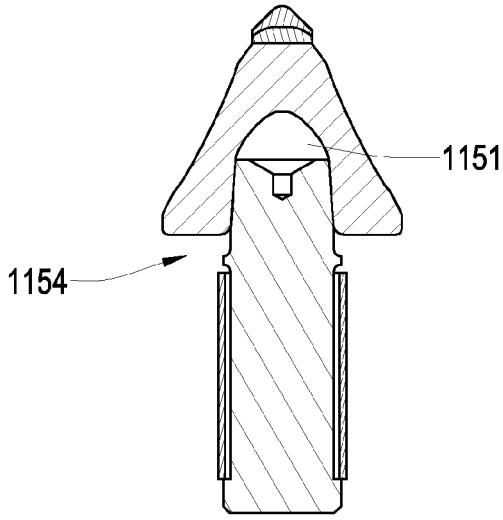
FIG. 14 is a cross-sectional diagram of another embodiment of a high-impact resistant pick.

FIG. 14 is a cross-sectional diagram of another embodiment of a pick. The shank 200 may comprise flanges 1154 that protrude from the shank. FIG. 14 comprises a space 1151 with a conical geometry. The bolster end may comprise slits along the axis. A sleeve may be radially disposed around a majority of the shank. The sleeve may be disposed loosely around the shank 208 and placed within the holder, which allows the sleeve to retain the shank while still allowing the shank to rotate within the holder.

Figure 15:
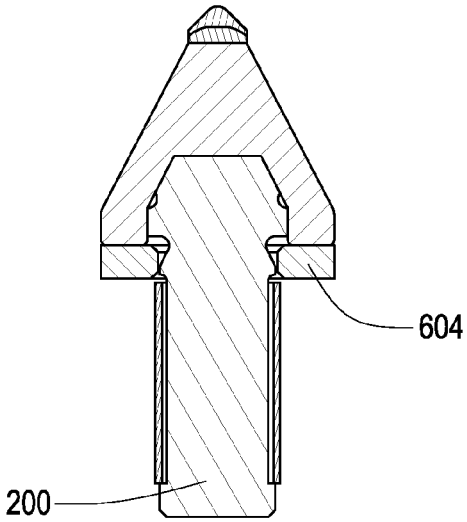
FIG. 15 is a cross-sectional diagram of another embodiment of a high-impact resistant pick.
Figure 16:
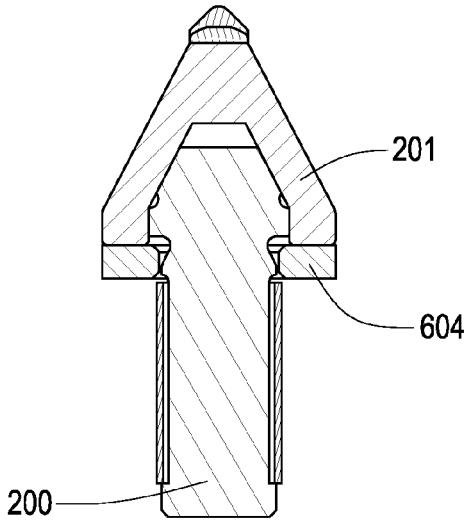
FIG. 16 is a cross-sectional diagram of another embodiment of a high-impact resistant pick.
Figure 17:
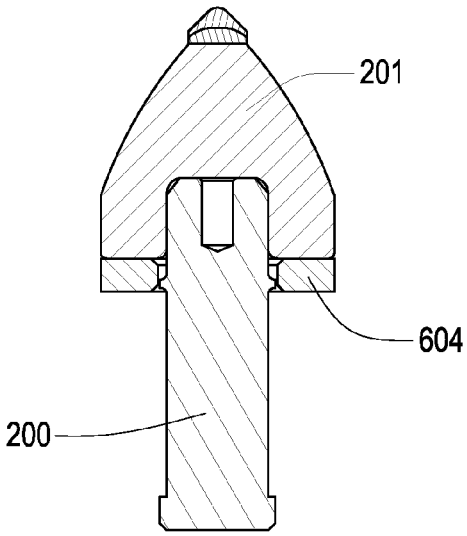
FIG. 17 is a cross-sectional diagram of another embodiment of a high-impact resistant pick.
Figure 18:
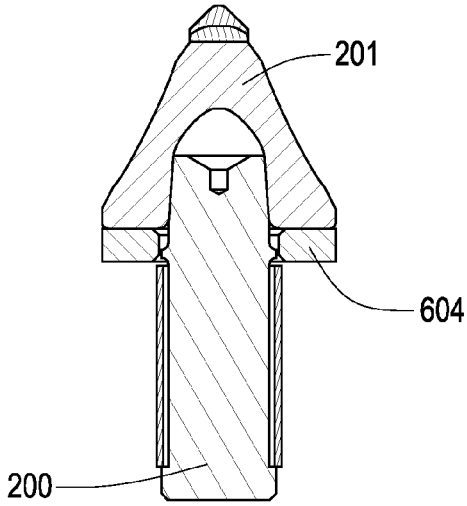
FIG. 18 is a cross-sectional diagram of another embodiment of a high-impact resistant pick.

Now referring to FIG. 15 the carbide bolster may be in contact with a washer that may be radially disposed around the shank. The washer 604 intermediate the carbide bolster 201 may increase the wear of the pick. The washer 604 may be completely perpendicular to the shank 200 such as shown in FIG. 15-18. The washer 604 may be in contact with the holder 102. The washer 604 may be fixed to the holder 102. During the milling process rotation may occur between the washer 604 and the carbide bolster 201.

Figure 19:
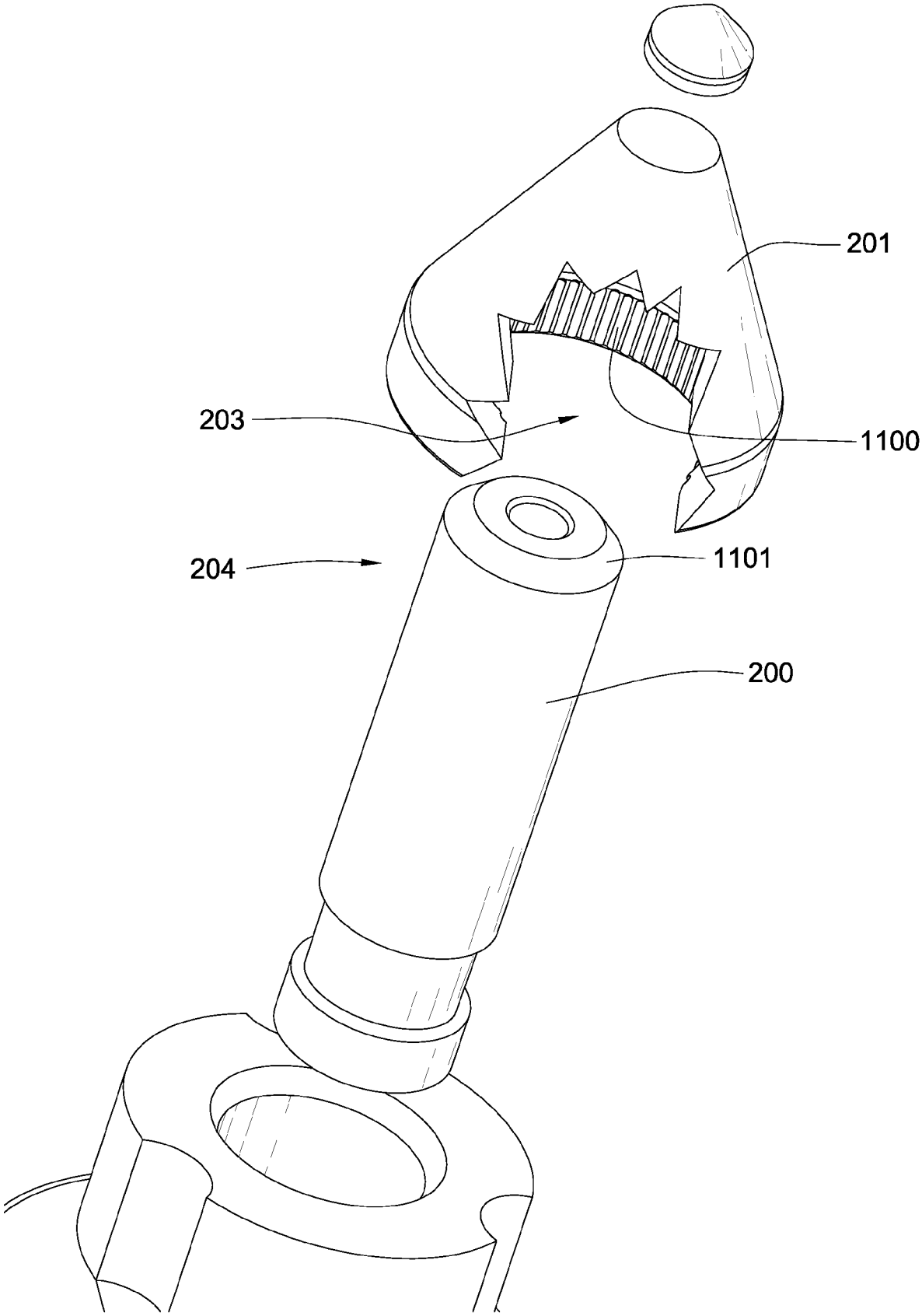
FIG. 19 is an exploded diagram of another embodiment of a high-impact resistant pick.

The bore 203 of the bolster 201 may comprise a plurality of serrations 1100, as in the embodiment of FIG. 19, which may aid in attachment between the shank 200 and the bolster 201. The serrations 1100 may comprise diamond or other super hard material. The bolster end 204 of the shank 200 may also comprise a bevel 1101 which may aid the press fitting.

Figure 20:
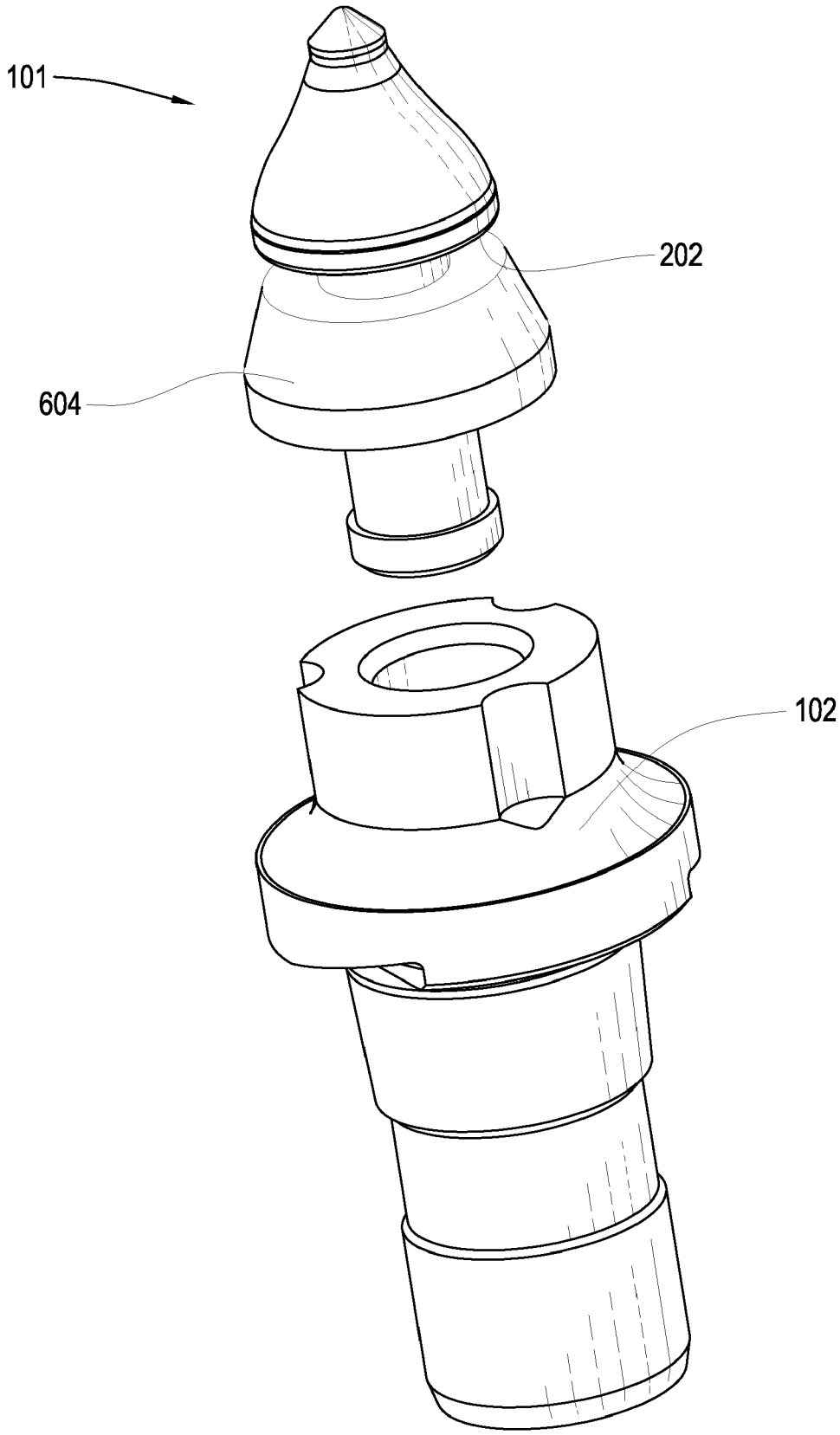
FIG. 20 is an exploded diagram of another embodiment of a high-impact resistant pick.

In FIG. 20 the holder 102 is an extension. A base end 202 of the bolster faces an upper surface of the washer 604. In this embodiment, the washer 604 comprises a height approximately equal to the height of the bolster. In some embodiments height may be between 0.200 and 0.750 inches.

Figure 21:
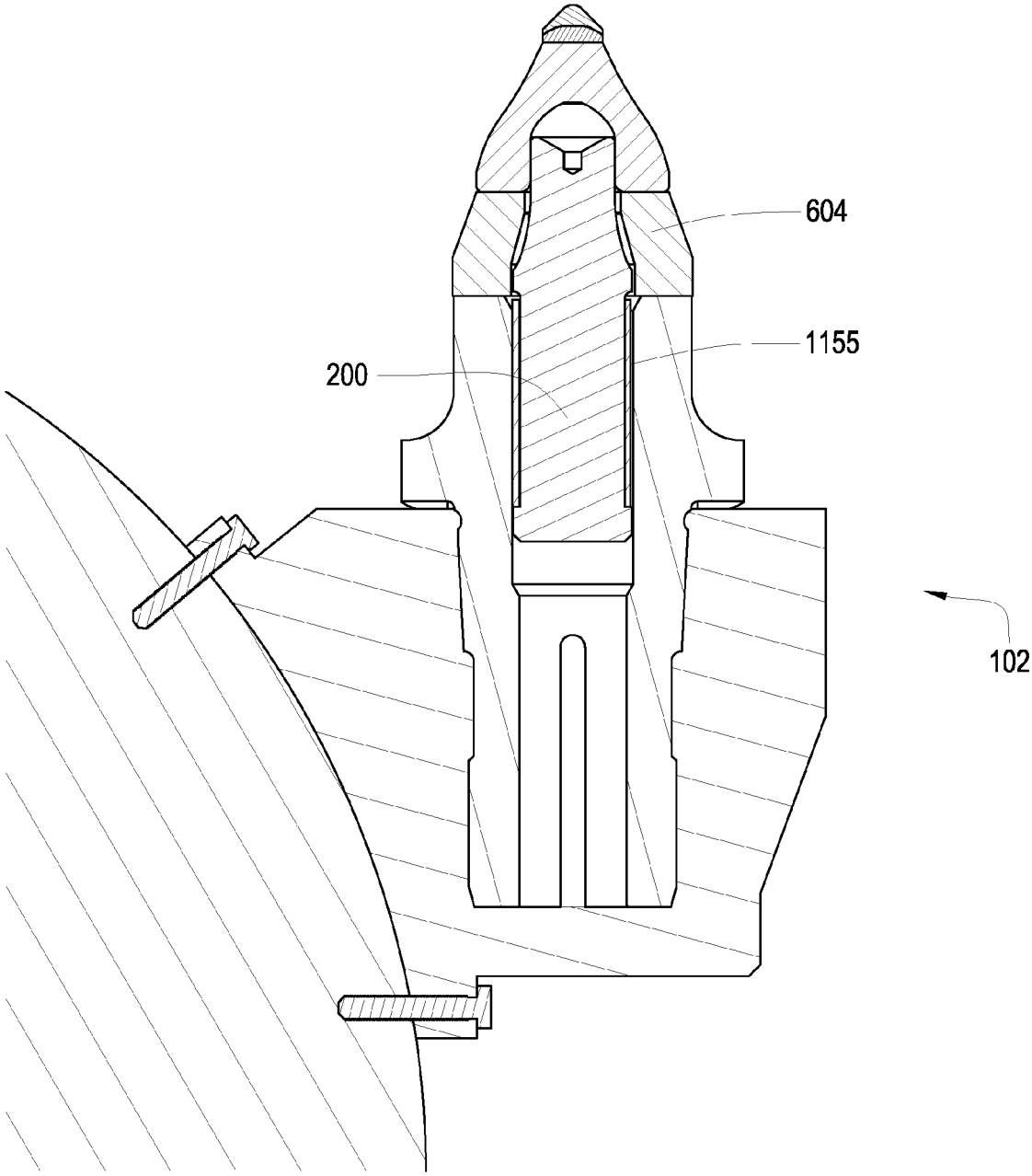
FIG. 21 is a cross-sectional diagram of another embodiment of a high-impact resistant pick.

FIG. 21 discloses a cross-sectional view of an embodiment of degradation assembly attached to a degradation drum. A bushing 1155 may be disposed intermediate the shank 200 and the holder 102 and may facilitate rotation of the shank with respect to the holder.

Inner and outer diameters of the washer may taper towards or away from the shank. The presence of the washer disposed intermediate carbide bolster and holder may prevent significant wear on the holder. Simultaneously, the washer may prevent contaminants from coming into contact with shank 200 and thereby reduce its wear.

Figure 22:
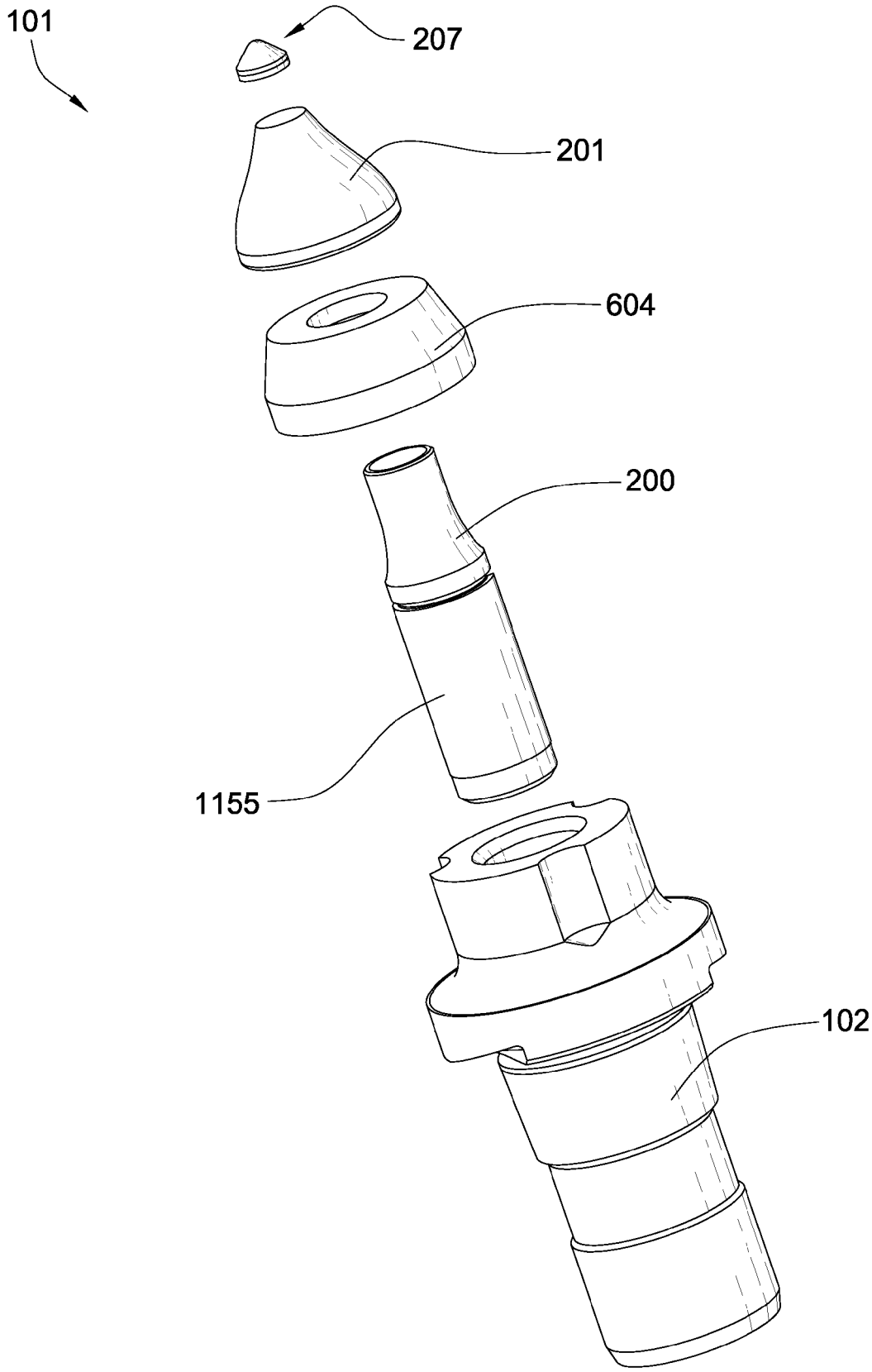
FIG. 22 is an exploded diagram of another embodiment of a high-impact resistant pick.

FIG. 22 discloses an exploded view of the pick 101. Bushing 1155 is clearly visible and disposed around shank 200. Tapered interface on shank is also clearly visible and may pass through inner diameter of shell and thence into tapered recess.

Figure 23:
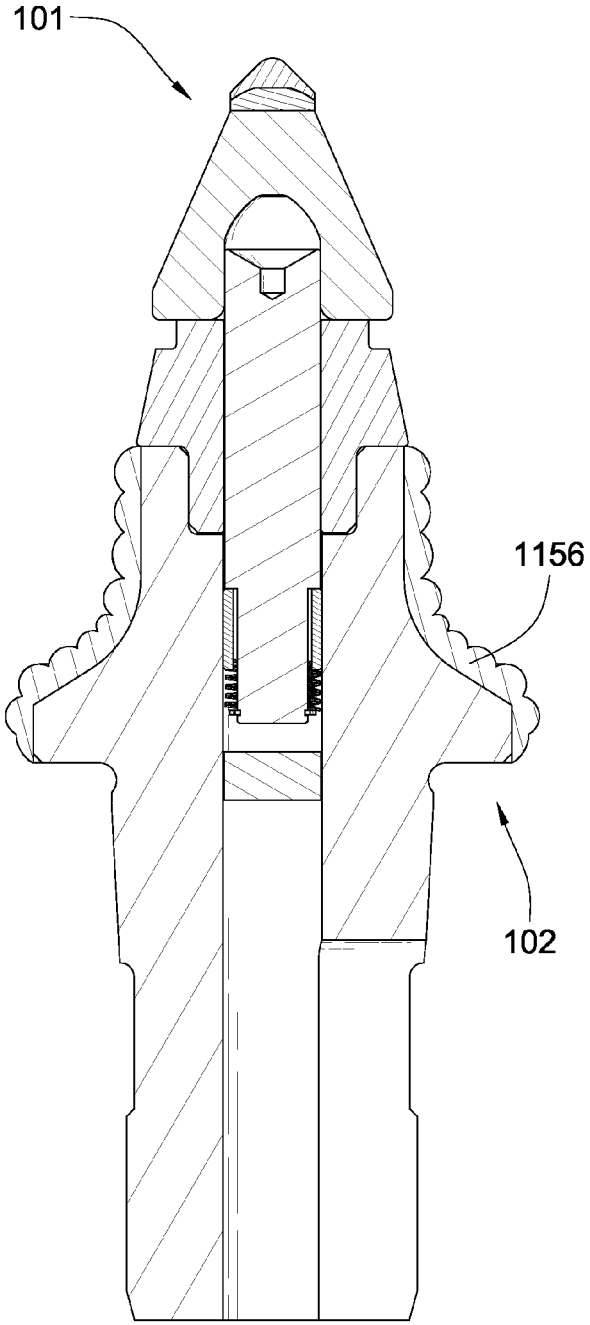
FIG. 23 is a cross-sectional diagram of another embodiment of a high-impact resistant pick.

In FIG. 23 an embodiment is disclosed in which shank comprises a spring adapted pull down on the shank. This may provide the benefit of keeping the pick snugly secured within the bore of the holder. FIG. 23 also discloses the placement of a hard material 1156 on an exposed surface of extension. Hard material may be disposed on other types of holders. Hard material may comprise at least one material selected from the group consisting of cobalt-base alloys, copper-base alloys, iron chromium alloys, manganese steel, nickel-base alloys, tool steel, tungsten carbide, and combinations thereof. Hard material may be applied to a surface by arc welding, torch welding, or by some other means.

Figure 24:
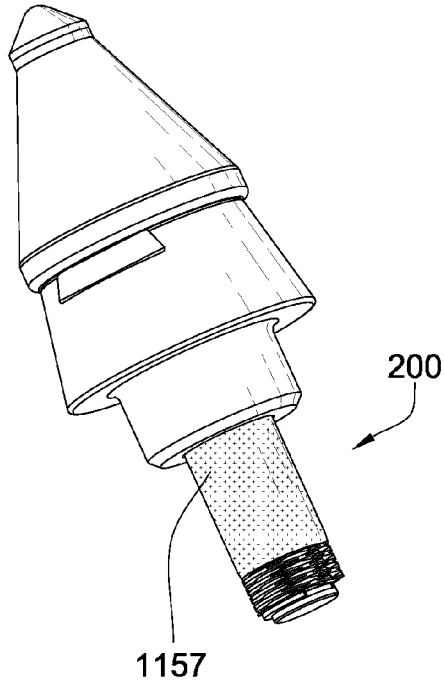
FIG. 24 is a perspective diagram of another embodiment of a high-impact resistant pick.

In some embodiments of the invention a coating 1157 of a hard material may be applied to the shank 200 or to the washer. The coating may be applied by electroplating, electroless plating, cladding, hot dipping, galvanizing, physical vapor deposition, chemical vapor deposition, thermal diffusion, or thermal spraying. The washer disclosed in FIGS. 23-24 also comprises a generally cylindrical portion that extends past distal surface of the holder and into it bore. In some embodiments of the invention cylindrical portion may be press fit into central bore.

Figure 25:
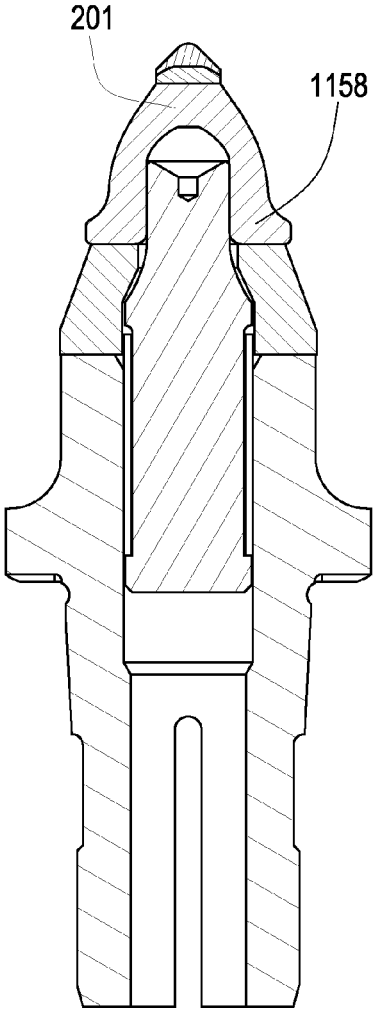
FIG. 25 is a cross-sectional diagram of another embodiment of a high-impact resistant pick.

FIG. 25 discloses a bolster 201 comprising a flange 1158 proximate the washer 604. In some embodiments, the thinnest cross section of the bolster from the inner surface to the outer surface may be between 0.0005 and 0.003 inches thick.

Figure 26:
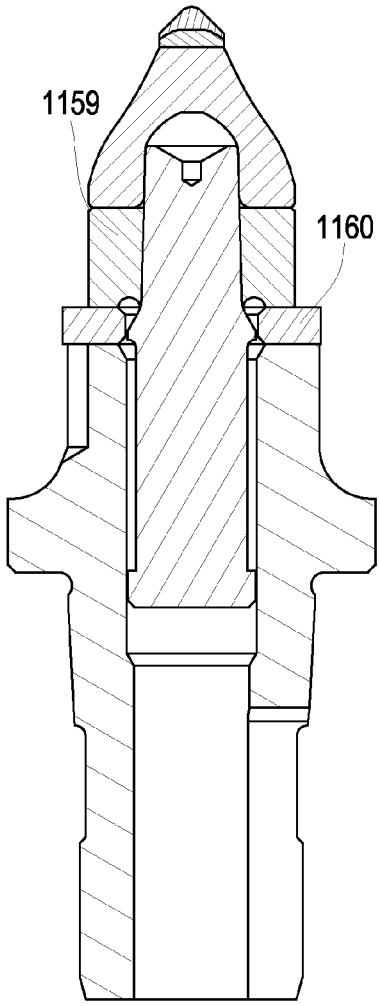
FIG. 26 is a cross-sectional diagram of another embodiment of a high-impact resistant pick.
Figure 27:
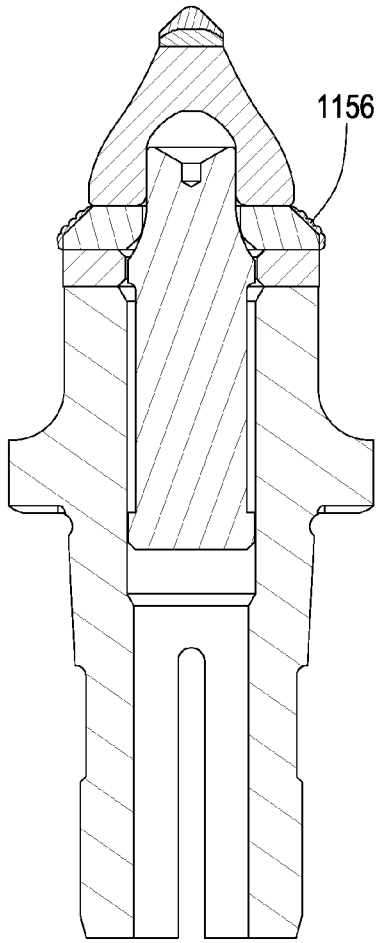
FIG. 27 is a cross-sectional diagram of another embodiment of a high-impact resistant pick.

FIG. 26 further discloses an embodiment with a two washers 1159, 1160. Washer 1159 is generally rectangular in its cross-sectional geometry while washer 1160 is a more thinner and wider. FIG. 27 also discloses another embodiment with two washers. In addition to having a relatively shorter washers, they also comprises a hard material 1156 disposed on their outer surface.

Figure 28:
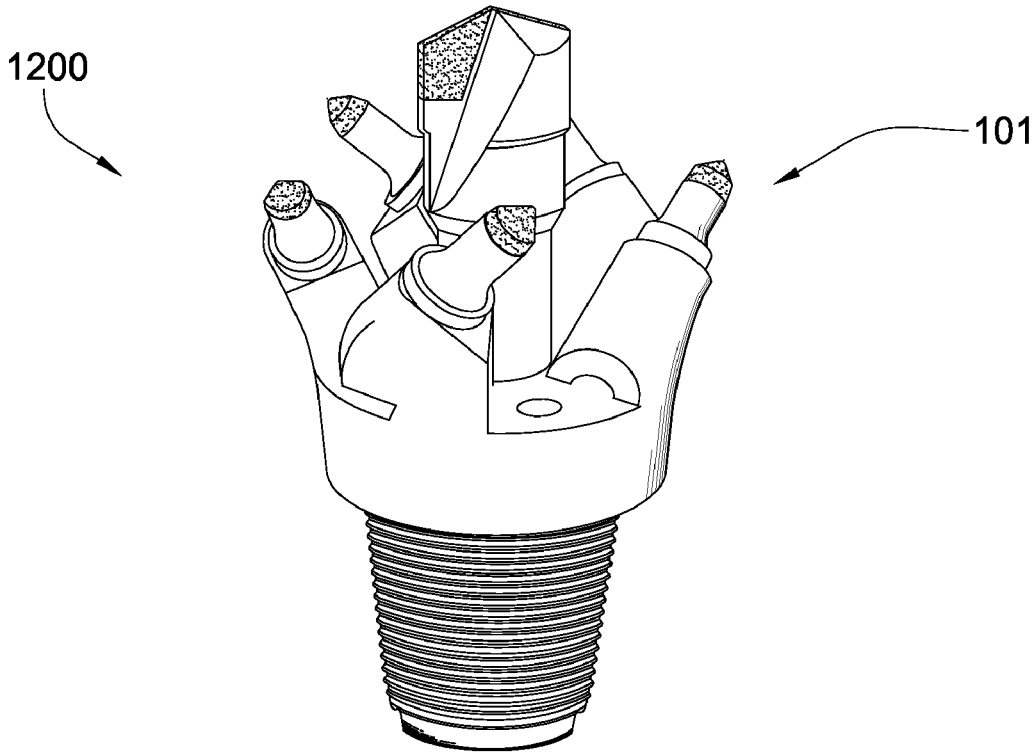
FIG. 28 is a perspective diagram of an embodiment of a drill bit.
Figure 29:
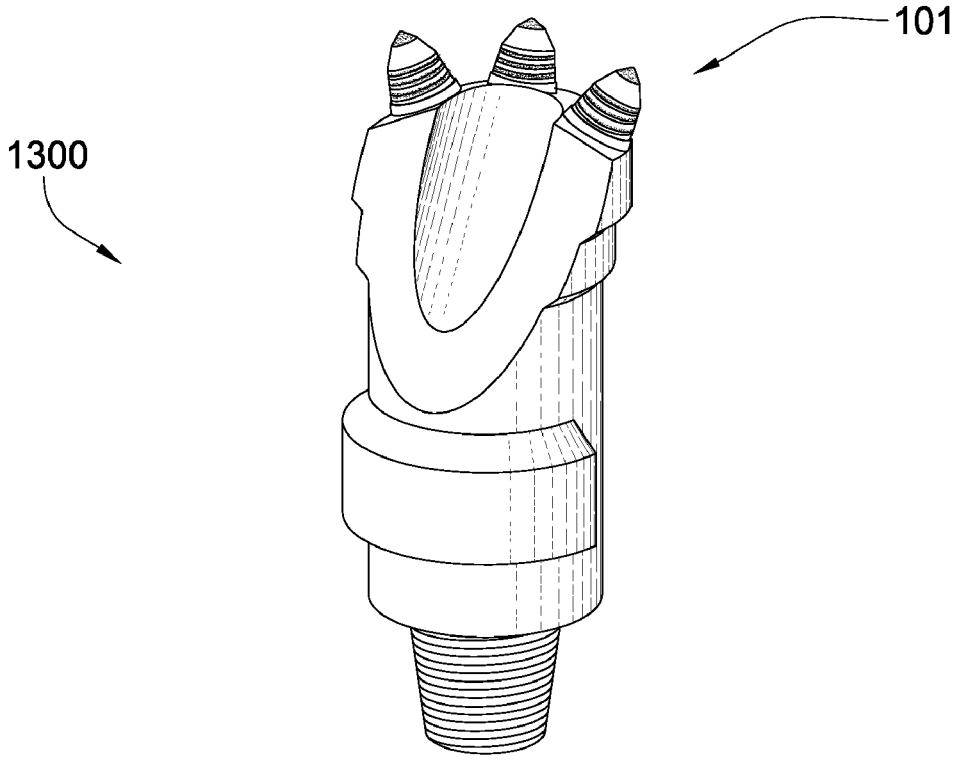
FIG. 29 is a perspective diagram of another embodiment of a drill bit.
Figure 30:
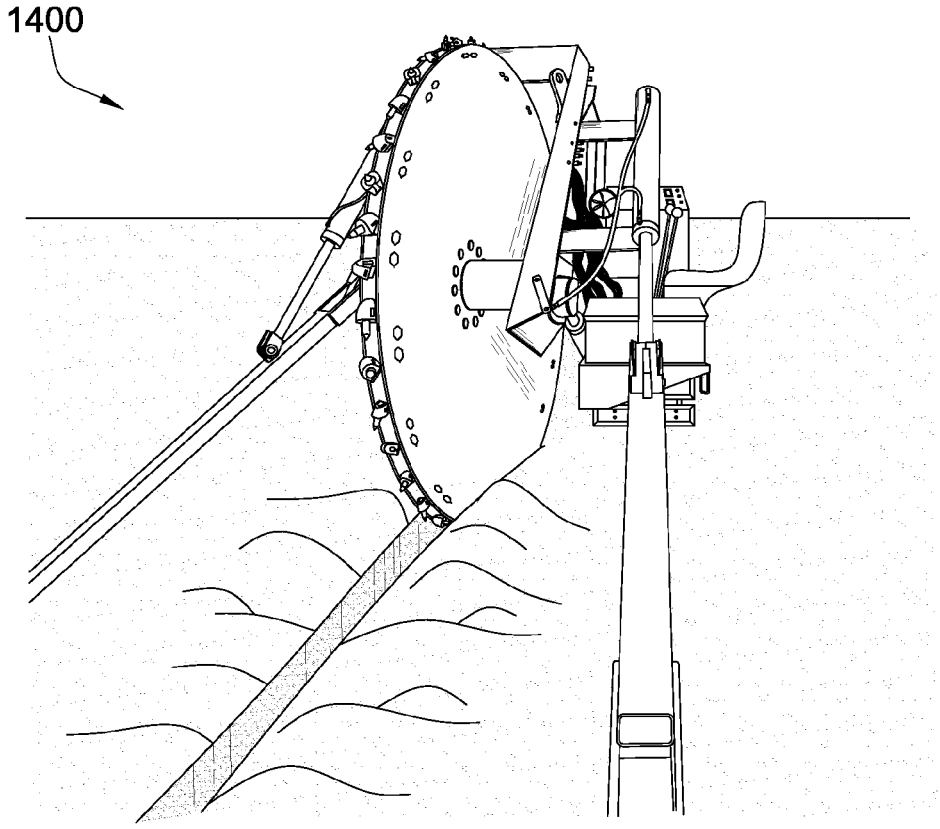
FIG. 30 is a perspective diagram of an embodiment of a trenching machine.
Figure 31:
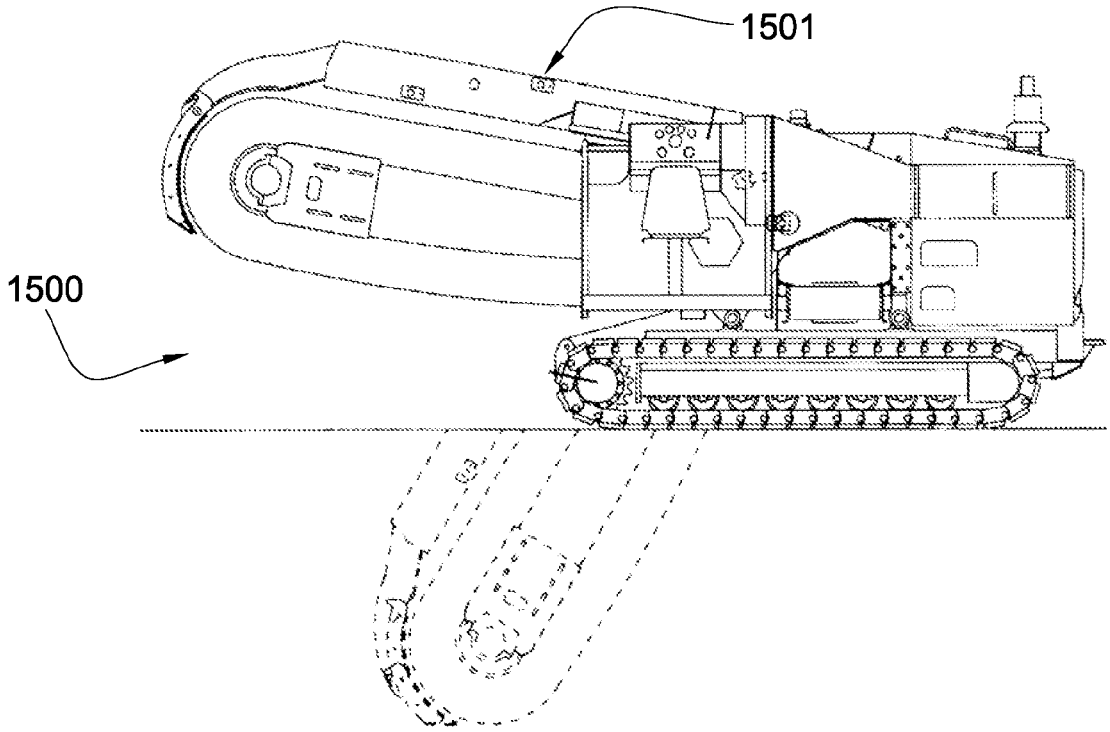
FIG. 31 is an orthogonal diagram of another embodiment of a trenching machine.
Figure 32:
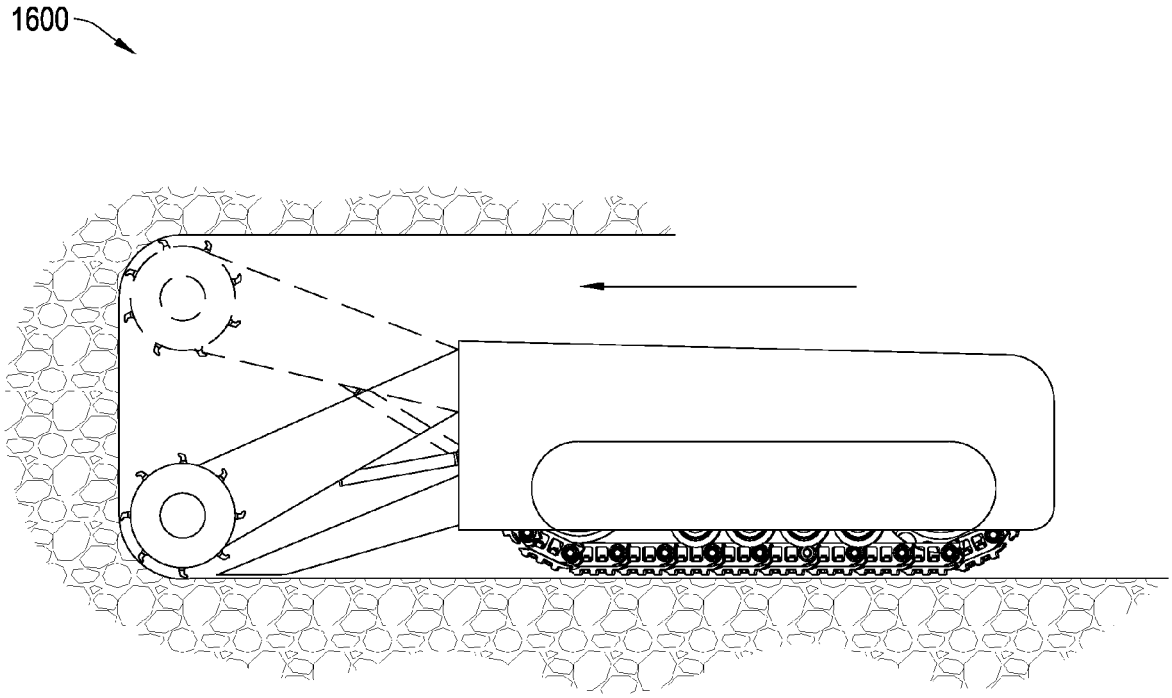
FIG. 32 is an orthogonal diagram of an embodiment of a mining machine.

The pick 101 may be used in a downhole rotary drill bit 1200, as in the embodiment of FIG. 28. The pick 101 may be used in a horizontal directional drill bit 1300, as in the embodiment of FIG. 29. The pick 101 may be used in trenching machines 1400, 1500, as in the embodiments of FIGS. 30 and 31. The pick may also be used in a mining machine 1600 for mining coal or other materials, as in the embodiment of FIG. 32.

Whereas the present invention has been described in particular relation to the drawings attached hereto, it should be understood that other and further modifications apart from those shown or suggested herein, may be made within the scope and spirit of the present invention.

What is claimed is:

1. An impact resistant pick, comprising;

a super hard material bonded to a cemented metal carbide substrate at a non-planar interface;

the cemented metal carbide substrate is bonded to a front end of a cemented metal carbide bolster;

a bore is formed in the base end of the carbide bolster generally opposed to the front end; and a bolster end of a shank is received within the bore and a holder end of the shank is adapted for connection to a holder; and the holder is in contact with the cemented metal carbide bolster;

wherein the shank comprises seals for lubrication disposed at an interface of the carbide bolster and holder end of the shank.

2. The pick assembly of claim 1, wherein the super hard material comprises a substantially pointed geometry with an apex comprising 0.050 to 0.165 inch radius.

3. The pick assembly of claim 1, wherein the carbide bolster comprises serrations on the interior of the carbide bolster adapted to engage the shank.

4. The pick assembly of claim 1, wherein the carbide bolster is press-fit onto the shank.

5. The pick assembly of claim 1, wherein a space exists between a ceiling of the carbide bolster and the shank.

6. The pick assembly of claim 1, wherein the super hard material is diamond that comprises a thickness of 0.100 to 0.500 inches.

7. The pick assembly of claim 1, wherein the bolster end of the shank is tapered.

8. The pick assembly of claim 1, wherein the bolster end of the shank is tapered comprises a substantially straight diameter.

9. The pick assembly of claim 1, wherein the base end of the bolster and/or the holder are polished.

10. The pick assembly of claim 1, wherein the depth of the bore in the bolster base end is less than one-third the overall length of the shank.

11. The pick assembly of claim 1, wherein the length of the bolster end of the shank that is press fit into the carbide bolster is 0.250 to 1 inch.

12. An impact resistant pick assembly, comprising;

a super hard material bonded to a cemented metal carbide substrate at a non-planar interface;

the cemented metal carbide substrate is bonded to a front end of a cemented metal carbide bolster;

a bore is formed in the base end of the carbide bolster generally opposed to the front end; and a bolster end of a shank is received within the bore and a holder end of the shank is adapted for connection to a holder; and a steel washer is disposed radially around the shank such that the steel washer is in contact with the cemented metal carbide bolster wherein the shank comprises seals for lubrication disposed at an interface of the carbide bolster and holder end of the shank.

13. The pick assembly of claim 12, wherein the steel washer is fixed to the holder and rotation is between the carbide bolster and the steel washer.

14. The pick assembly of claim 12, wherein the steel washer comprises a hard material selected from the group consisting of tungsten, diamond, cobalt, cubic boron nitride, or a combination thereof.

15. The pick assembly of claim 12, wherein the shank comprises a slit on the bolster end.

* * * * *